United States Patent [19]

Abodishish

[11] Patent Number: 5,035,404

[45] Date of Patent: Jul. 30, 1991

[54] RETORT ASSEMBLY FOR KROLL REDUCTIONS

[75] Inventor: Hani A. M. Abodishish, Ogden, Utah

[73] Assignee: Westinghouse Electric Corp., Pittsburgh, Pa.

[21] Appl. No.: 581,947

[22] Filed: Sep. 13, 1990

[51] Int. Cl.[5] ..... F27B 5/05

[52] U.S. Cl. ..... 266/148; 266/149; 266/905

[58] Field of Search ..... 266/171, 905, 148, 149

[56] References Cited

U.S. PATENT DOCUMENTS 3,715,205 2/1973 Ishizuka ..... 266/905

*Primary Examiner*—Melvyn J. Andrews

*Attorney, Agent, or Firm*—J. C. Valentine

[57] ABSTRACT

A retort assembly comprises a retort defining a first chamber for containing zirconium tetrachloride. A crucible having a generally vertical sidewall defines a second chamber for containing magnesium and the reaction products. A vapor passageway extends from an inlet in the first chamber to an outlet in the second chamber. A diffusion means is disposed in the second chamber adjacent the outlet of the vapor passageway for diffusing vapor toward the sidewall of the crucible. The diffusion of vapors toward the sidewall of the crucible creates turbulence in the area of the crucible sidewall and a liquid circulation pattern which is downward along the crucible sidewall. Sponge discs produced under these conditions develop inwardly of the sidewall of the crucible, have less iron and are more compact than are sponge discs produced in prior art assemblies. Also, the skull losses are lower.

8 Claims, 2 Drawing Sheets

RETORT ASSEMBLY FOR KROLL REDUCTIONS

BACKGROUND OF THE INVENTION

The invention relates to a retort assembly for the Kroll reduction of a metal in chloride form with a reducing metal.

Titanium, zirconium and hafnium are commercially produced by the reduction of these metals in chloride form (from upstream processing steps) with a reducing metal, such as with magnesium, to form a metallic sponge disc. The sponge disc is typically consolidated and further processed. In the production of zirconium, for example, zirconium tetrachloride powder is placed in the annular chamber of a reduction retort having a centrally located, downwardly facing vapor flow pipe. Metallic magnesium is placed in a crucible and the crucible is then welded or otherwise suitably attached to the bottom of the retort with the vapor flow pipe extending downwardly into the crucible. The assembly is then evacuated and its contents brought up to process temperature to vaporize the zirconium tetrachloride and to melt the magnesium. The vapor in the retort is then permitted to flow through the vapor flow pipe and into the crucible where it reacts with the liquid magnesium to form zirconium and magnesium chloride.

The product from the above Kroll reduction process is a disc-shaped solid which generally comprises two fairly well defined portions. A cup-shaped portion comprised of zirconium which generally takes the shape of the crucible is commonly referred to as the "sponge" or as the "sponge disc". A second portion comprised of magnesium chloride extends downwardly into the cup-shaped portion. The disc-shaped solid develops such a configuration because the downwardly flowing zirconium tetrachloride vapors generate sufficient turbulence in the central portion of the liquid magnesium in the crucible to entrain the zirconium particles which are formed and thereby retard their deposition in the center. The zirconium particles are circulated to less turbulent peripheral portions of the liquid in the crucible where they form a skull against the walls of the crucible and a sponge disc which develops inwardly from the skull.

The skull (which may be 25 to 40 millimeters thick) tends to weld with crucible walls and remain in the crucible when the solid disc is mechanically removed from the crucible. Although such a skull represents an obvious product loss, it is generally considered to be an unavoidable loss because the skull is contaminated by iron from the crucible walls (or from a crucible liner). Even with the formation of a skull, the sponge disc from the above described Kroll process may have a high iron content.

SUMMARY OF THE INVENTION

It is an object of the present invention to produce high quality sponge discs which are low in iron.

It is a further object of the invention to produce high quality sponge discs with greater recoveries; and, more specifically, with lower skull losses in the reduction retort assembly.

With these objects in view, the present invention resides in a reduction retort assembly generally comprising a retort which defines a first chamber for containing a metallic chloride such as zirconium tetrachloride and the like. A crucible having a generally vertical sidewall generally defines a second chamber for containing a reducing metal such as magnesium. A communicating vapor passageway extends from an inlet in the first chamber to an outlet in the second chamber. A vapor diffusion means is disposed in the second chamber adjacent to the outlet of the vapor passageway for diffusing the vapor toward the sidewall of the crucible. It has been found that such a structure develops a turbulence and circulation pattern in the liquid which retards the development of a skull and promotes the formation of a sponge disc in the central portion of the liquid and thereby substantially reduces the diffusion of iron from the crucible walls into the sponge disc due to smaller surface area where the sponge disc is in contact with the crucible (liner) wall and bottom.

In a preferred embodiment of the invention, the outlet of the vapor passageway comprises an outwardly diverging cone and a diffusion means is a cone disposed within the diverging cone.

DESCRIPTION OF THE DRAWINGS

The invention will become more readily apparent from the following description of a preferred embodiment thereof shown, by way of example only, in the accompanying drawings, wherein.

DESCRIPTION OF THE PREFERRED EMBODIMENT

Figure 1:
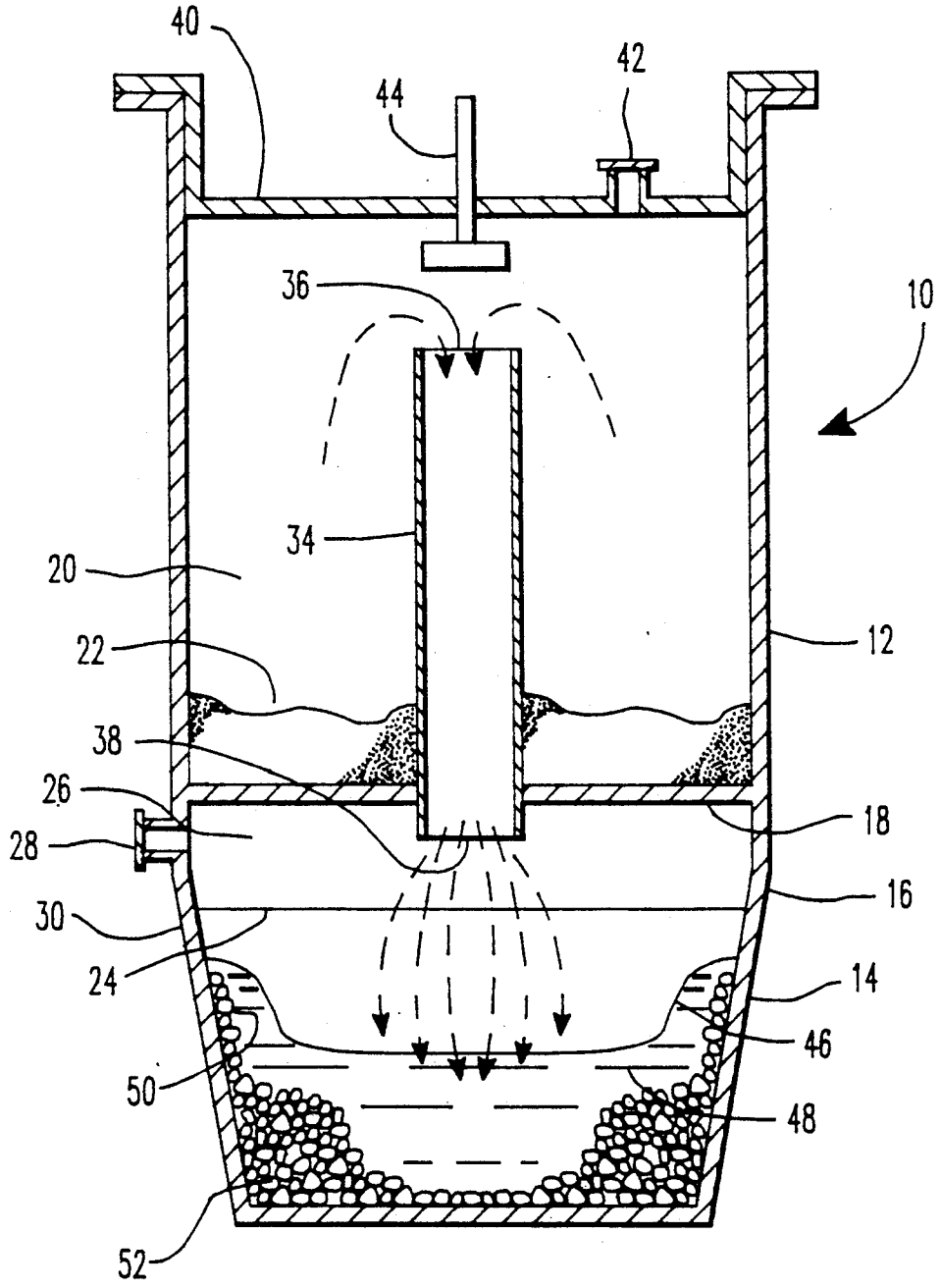
FIG. 1 PRIOR ART
FIG. 1 is a schematic representation of a prior art reduction retort assembly.

FIG. 1 generally represents a prior art reduction retort assembly 10 comprising a retort 12 and a crucible 14 during the metal reduction step.

The retort 12 of FIG. 1 has a cylindrical side wall 16 and a raised bottom 18 which generally define a first chamber 20 for containing a feed 22 such as zirconium tetrachloride or the like. The crucible 14 as shown in FIG. 1 has an upper edge 24 which is welded to the sidewall 16 of the retort 12. The crucible 14 generally defines a second chamber 26 which contains feed magnesium and the reaction products. The crucible 14 typically is welded to the retort 12 at the start of a reduction run and later is burned or cut from the retort 12 to recover a solid disc for further processing. A vacuum connection 28 may be provided on the retort sidewall 16 or, alternatively, on the crucible sidewall 30 for drawing a vacuum on the second chamber 26 before the metal reduction step.

A vapor passageway such as a centrally located pipe 34 extends vertically through the bottom 18 of the retort 12. The pipe 34 has an inlet 36 disposed in the first chamber 20 of the retort 12 and an outlet 38 in the second chamber 26 of the crucible 14 for permitting the flow of zirconium tetrachloride vapors from the first chamber 20 to the second chamber 26 as shown in FIG. 1. The retort 12 has an air-tight lid 40 for holding a vacuum drawn by an evacuation system (not shown) on the first chamber 20 via a vacuum connection 42 before the reduction step is initiated. After the retort assembly 10 has been evacuated and brought up to temperature, a seal breaker 44 threadably supported by the lid 40 is advanced to cut a frangible seal (not shown) previously installed on the pipe inlet 36, which permits the zirconium tetrachloride vapors to flow through the pipe 34 and downwardly impinge on the surface 46 of a liquid pool 48 in the crucible 14 and react with the then liquid magnesium.

As FIG. 1 indicates, a skull 50 and a sponge disc 52 develop in the liquid pool 48 during the reduction step. As FIG. 1 also indicates, the pool surface 46 may be substantially depressed at high vapor velocities. The impinging flow of vapors generates considerable turbulence and violent reaction in the center of the liquid pool 48 and induces a circulation pattern in the liquid pool 48 which is generally upwardly directed along the sidewall 30 of the crucible 14 and high above the developing sponge disc 52. Thus, the solid zirconium particles which are formed by the reaction of zirconium tetrachloride and magnesium are carried by the circulating liquid to the periphery of the liquid pool 48, which is the least turbulent portion, where a relatively high skull 50 forms along the sidewall 30 of the crucible 14 and the sponge disc 52 develops inwardly from the skull 50.

It is theorized that the circulation pattern and central turbulence of the liquid pool 48 in the crucible 14 of FIG. 1 connectively heats the skull 50 and the sponge disc 52 as it develops inwardly from the skull 50 due to the exo-thermic reaction that occurs in the center zone. This tends to maintain the skull 50 and the developing sponge disc 52 at sufficiently high temperatures to diffuse substantial amounts of iron from the crucible 14 and through the skull 50.

Figure 2:
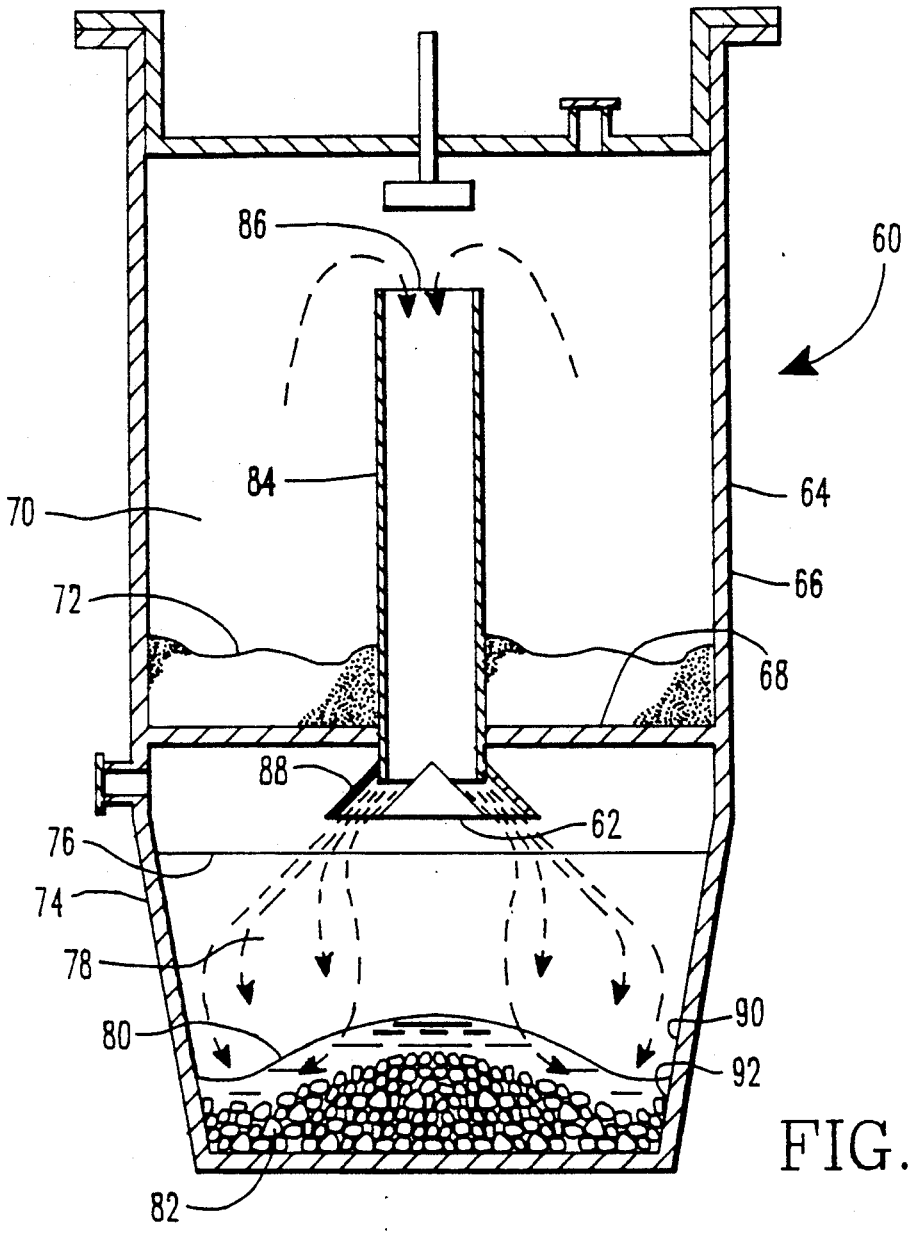
FIG. 2 is a schematic representation of an improved reduction retort assembly embodying the present invention.

FIG. 2 represents a reduction retort assembly 60 embodying the present invention which incorporates a diffusion means 62 into the structure of the above described reduction retort assembly 10. Thus the improved retort assembly 60 generally comprises a retort 64 having a cylindrical sidewall 66 and a raised bottom 68 which defines a first chamber 70 for containing zirconium tetrachloride feed 72. A crucible 74 welded to the retort 64 along its upper edge 76 generally defines a second chamber 78 for containing the magnesium feed, a magnesium chloride liquid pool 80 and a sponge disc 82. A vertical pipe 84 having an inlet 86 and an outlet 88 extends through the bottom 68.

As is shown in FIG. 2, the diffusion means 62 is adjacent the outlet 88 of the vapor flow pipe 84 and directs the zirconium tetrachloride vapors toward the sidewall 90 of the crucible 74. This tends to reverse the conditions in the liquid pool 80 as compared with the prior art liquid pool 48. Thus, circulation is downwardly along the crucible sidewall 90 and upwardly in the interior portion of the liquid pool 80. Also the greatest turbulence in the liquid pool 80 occurs along the crucible sidewall 84. Preferably, the diffusion means 62 diffuses substantially all of the downwardly flowing vapors toward the crucible sidewall 90 so that there is little vapor impingement on the central portion of the liquid pool 80 to induce the turbulence and thereby to oppose the formation of the sponge disc 82 in the interior of the crucible 74.

It is theorized that a sponge disc 82 and a skull 92 develop somewhat independently of each other in the improved assembly 60. The sponge disc 82 first develops in the central portion of the liquid pool 80 and eventually contacts the skull 92 along the sidewall 92 later in a run so that there is less time to diffuse iron into the sponge disc 82 than there is in prior art assemblies. Also, the circulation pattern tends to depress the liquid pool level at the crucible sidewall 90 so that a high skull 92 does not develop. It is also theorized that at very high vapor flows, the central portion of the sponge disc 82 may be substantially higher than the peripheral portion of the sponge disc 82 near the crucible sidewall 90 during at least a portion of a run so that a large area of contact between the sponge disc 82 and the crucible wall 90 or its skull 92 does not develop until relatively late in the run.

Figure 3:
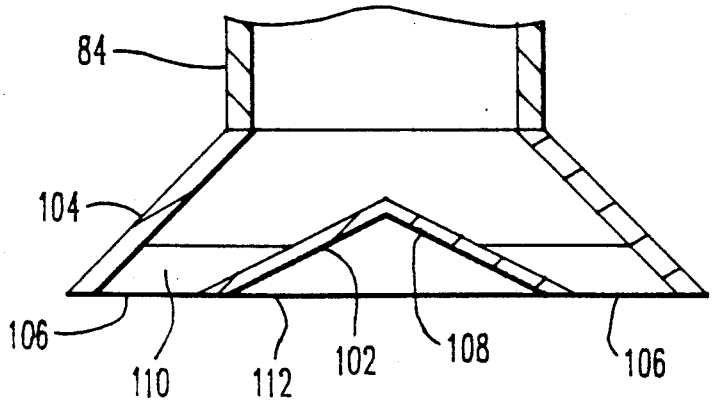
FIG. 3 is a schematic representation of a vapor diffusion means.

FIG. 3 shows a preferred diffusion cone 102 which is supported by a truncated diverging cone 104 via cross-supports 106. The apex 108 of the diffusion cone 102 and the relative angles between the two cones 102 and 104 are arranged to develop maximum vapor velocity in the annulus 110 near the base 112 of the cone 102 to control vapor flow and to limit plugging.

It has been found that zirconium sponge discs produced by an improved retort assembly 60 contain less iron than do sponge discs produced by the prior art retort assembly 10. In addition, the skull which develops in the improved retort assembly 60 does not rise as high as does the skull which develops in the prior art assembly 10. Thus product loss due to skull formations are lower.

In a comparison of a retort assembly 10 and an improved retort assembly 60 under generally similar conditions, a routine production run was conducted on the retort assembly 10 and another routine production run was conducted on a modified retort assembly which had been retrofitted as shown in FIG. 2. The prior art retort assembly 10 produced a donut shaped sponge disc having a height of about 60 centimeters (28 inches) and a skull which rose about 50 centimeters (21 inches) higher than the sponge disc. The improved retort assembly 60 produced a generally flat sponge disc having a height of about 40 centimeters (16 inches) and a skull which rose about 15 centimeters (6 inches) higher than the sponge disc. Thus, the skull height along the crucible sidewall was less than half the skull height produced by the prior art reduction retort assembly 10. Because of the overall configuration of the sponge disc, the skull losses may be reduced by up to 70%. In addition to reduced losses, the intensive labor required to remove the skull is substantially reduced as well. More importantly, the iron content of the sponge disc produced in the improved retort assembly 60 was an order of magnitude less than the sponge disc produced in the prior art assembly 10.

I claim:

1. A retort assembly for the Kroll reduction of a metallic chloride by a reducing metal, comprising:

a retort defining a first chamber for containing a metallic chloride;

a crucible having a generally vertical sidewall, the crucible generally defining a second chamber for containing a reducing metal and the reduction products;

a vapor passageway extending from an inlet in the first chamber to an outlet in the second chamber;

a diffusion means in the second chamber adjacent the outlet of the vapor passageway having a surface extending outwardly of and downwardly away from the passageway for diffusing vapor toward the sidewall of the crucible.

2. The retort assembly of claim 1, wherein the diffusion means is a diffusion cone in the second chamber, the cone having an apex adjacent the inlet of the vapor passageway.

3. The retort assembly of claim 2, wherein the outlet of the passageway comprises an outwardly diverging cone and the diffusion cone is disposed within the diverging cone.

4. A retort assembly for the Kroll reduction of a metallic chloride by a reducing metal, comprising:

a retort having a generally vertical sidewall and a bottom, the retort defining a first chamber for containing a metallic chloride;

a crucible having a generally vertical sidewall welded to the sidewall of the retort below the bottom of the retort, the crucible defining a second chamber for containing a reducing metal;

a pipe extending through the bottom of the retort, the pipe having an inlet disposed in the first chamber and an outlet disposed in the second chamber, the outlet spaced from the sidewall of the crucible; and a vapor diffusion cone in the second chamber, the cone having an apex adjacent the outlet of the pipe and a surface extending outwardly of and downwardly away from the pipe for diffusing vapor toward the crucible sidewall.

5. The retort of claim 4, wherein the pipe outlet comprises an outwardly diverging cone and the diffusion cone is disposed within the outwardly diverging cone.

6. The retort of claim 5, wherein the diffusion cone is supported by the pipe.

7. The retort of claim 6, wherein the diffusion cone has a base diameter which is greater than the inner diameter of the pipe.

8. The retort of claim 7, wherein the annular cross-sectional area between the base of the diffusion cone and the diverging cone is less than the cross-sectional area of the pipe, whereby the vapor velocity is greater in the annulus than in the pipe.

* * * * *